US005149419A

United States Patent [19]

Sexton et al.

[11] Patent Number: 5,149,419

[45] Date of Patent: Sep. 22, 1992

[54] METHOD FOR FABRICATING LONG ARRAY ORIFICE PLATES

[75] Inventors: Richard W. Sexton; James E. Harrison, Jr., both of Dayton, Ohio

[73] Assignee: Eastman Kodak Company, Rochester, N.Y.

[21] Appl. No.: 732,281

[22] Filed: Jul. 18, 1991

[51] Int. Cl.[5] ..... C25D 1/08

[52] U.S. Cl. ..... 205/75; 205/67; 205/96

[58] Field of Search ..... 204/3, 11; 205/67, 75, 205/96

[56] References Cited

U.S. PATENT DOCUMENTS

| | | | |
|---|---|---|---|
| 2,675,348 | 4/1954 | Greenspan | 204/297 |
| 4,067,782 | 1/1978 | Bailey et al. | 204/25 |
| 4,184,925 | 1/1980 | Kenworthy | 204/11 |
| 4,246,076 | 1/1981 | Gardner | 204/11 |
| 4,374,707 | 2/1983 | Pollack | 204/11 |
| 4,855,020 | 8/1989 | Sirbolo | 204/23 |

OTHER PUBLICATIONS

F. A. Lowenheim, *Electroplating*, McGraw-Hill Book Co., New York, 1978, p. 147.

*Primary Examiner*—John Niebling
*Assistant Examiner*—William T. Leader
*Attorney, Agent, or Firm*—Thomas H. Close

[57] ABSTRACT

A method for electroforming linear orifice plates includes the steps of: placing electrically conductive robber panels adjacent edges of an electrically conductive plating substrate bearing a linear insulative peg pattern; coupling the plating surface of the plating substrate to the adjacent robber panels with a thin strip of electrically conductive material; and electroplating to form an orifice plate with precisely uniform diameter orifices.

5 Claims, 2 Drawing Sheets

METHOD FOR FABRICATING LONG ARRAY ORIFICE PLATES

FIELD OF INVENTION

The present invention relates to continuous ink jet printing and, more particularly, to improved methods for fabricating relatively long, high resolution, orifice plates for use in ink jet printing.

BACKGROUND OF INVENTION

In continuous ink jet printing of the multiple jet type, ink is circulated under pressure to project from a plurality of orifices formed in a linear array along an orifice plate. The projected ink jets are stimulated to break off adjacent charge electrodes; and, in the usual, binary printing approach, charged drops are field-deflected to a catcher, with non-charged drops continuing to the print medium.

Commercial systems employing the continuous binary ink jet approach have been successfully employed using longer (e.g. page width) orifice plates of lower resolution (e.g. 120 orifices per inch) and shorter (e.g. line height) orifice plates having high resolution (e.g. 300 orifices/inch). Intermediate length orifice arrays having intermediate resolution have also been used successfully.

The short orifice plates have been used in moving print heads which traverse lines of the print media successfully moved therepast. The long and intermediate length orifice plates have been used with stationary print heads, but suffer the problems of lower resolution. To provide the ability to address wider swaths of the print media, with stationary print heads at higher resolution, with stationary print heads it has been suggested to stagger long, low resolution orifice plates in interleaved positions along the print media path. This requires great precision in alignment and in media-movement/drop address synchronization to yield acceptable quality, and has not commercially been feasible.

Thus, there has been a continuing need for ways to provide relatively longer, high resolution orifice plates, to enable reliable stationary-printhead address of large widths of moving print. A large number of techniques have been utilized for orifice plate fabrication; however, the most successful for forming high resolution orifice plates with precisely uniform size orifices has been the electroform method described in U.S. Pat. No. 4,184,925. In this approach, precisely sized photoresist pegs are formed on an electroplating substrate and the orifice plate is electroplated up to the top of the pegs and slightly thereover to achieve a precise diameter that is regulated by the plating time period. This fabrication method has been achieved successfully with shorter length orifice plates; however, precise orifice size uniformity has not heretofore been achieved with longer length arrays.

SUMMARY OF INVENTION

One significant purpose of the present invention is to provide an improved method for electroforming relatively longer orifice plates, with high resolution orifice arrays and precise orifice size uniformity. The invention provides important advantages by allowing wider swaths of print media to be printed in high resolution with a single stationary print head.

In one aspect, the present invention constitutes a method for electroforming linear orifice plates comprising the steps of:

(a) forming a linear array pattern of electrically insulative, uniform diameter and height pegs, corresponding to a desired orifice array pattern, on an electrically conductive plating substrate;

(b) placing electrically conductive robber panels adjacent the edges of the plating substrate that are perpendicular to the linear array pattern;

(c) coupling the pattern bearing surface of the plating substrate to coplanar surfaces of adjacent robber panels with a thin strip of electrically conductive material;

(d) placing the coupled plating substrate/robber panel unit in an electroplating system; and (e) operating that system to form an orifice plate having a thickness slightly greater than the peg pattern height and a linear array of precisely uniform diameter orifices.

BRIEF DESCRIPTION OF DRAWINGS

The subsequent description of preferred embodiments refers to the accompanying drawings wherein.

DETAILED DESCRIPTION OF PREFERRED EMBODIMENTS

Figure 1:
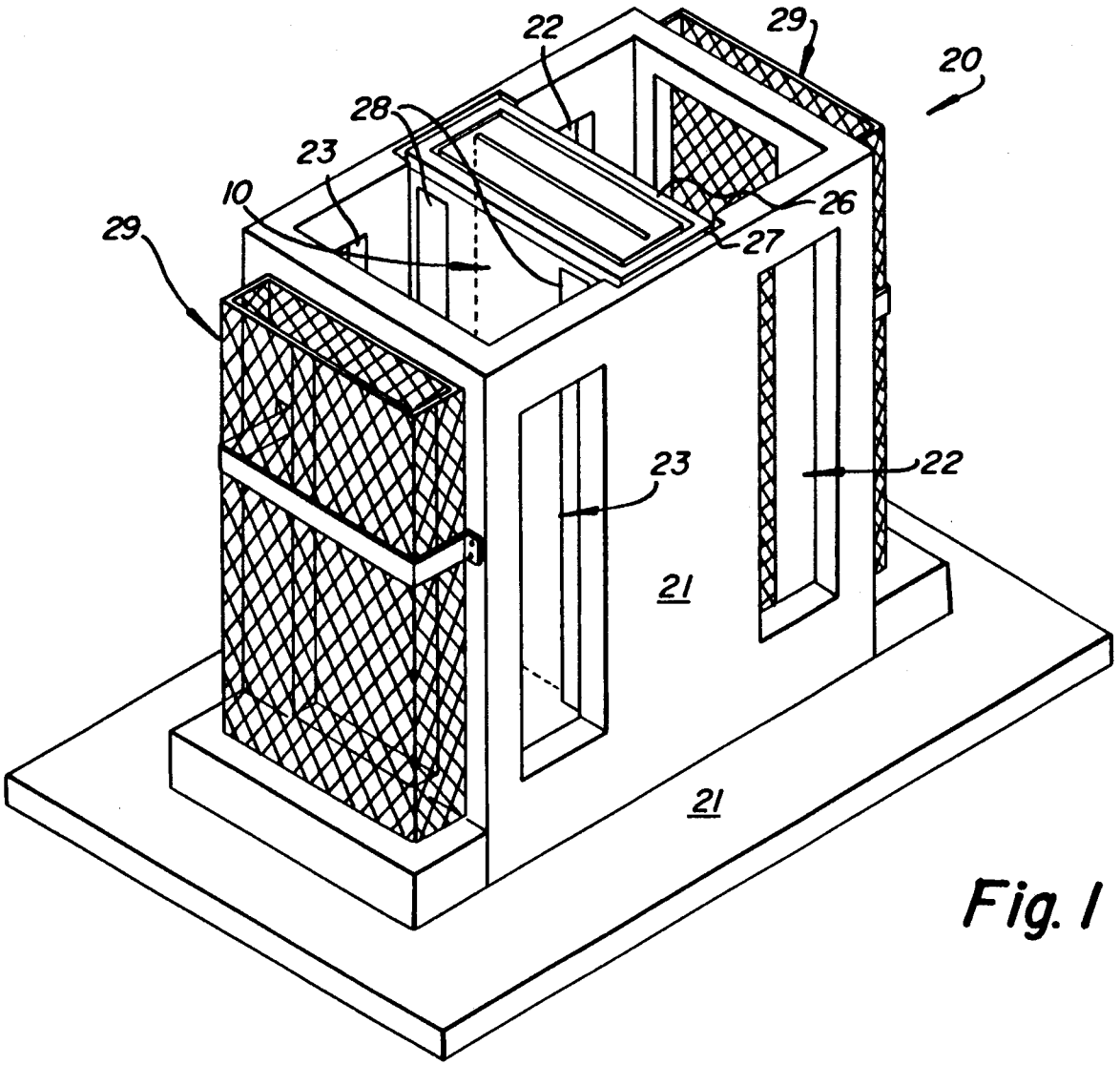
FIG. 1 is a perspective view of one electroplating system useful in practicing the present invention.

FIG. 1 shows an electroplating system 20 which can be immersed in an electroplating bath and electrically energized to effect orifice plate formation in accord with the present invention. The system 20 comprises a plastic frame 21 having windows 22, 23, which allow flow of electroplating solution into plating relation with substrate units 10 held in a plating fixture 26. Fixture 26 is insertable into support notches 27 of frame 21 and includes plastic shield elements 28 that fasten to the edges of the fixture 26 to hold the substrate units 10 in proper position in the electroplating system. Titanium anode baskets 29 are mounted on each end of the frame 21 with their major surfaces parallel to major surfaces of the plating substrate units 10. This is to provide a plating field generally normal to the major surfaces of the substrate units.

Figure 2A:
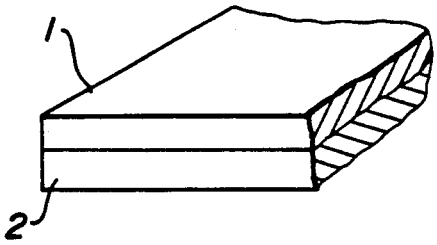
FIGS. 2A and 2B are schematic perspective views showing successive stages of formation of a plating substrate for use in the present invention.
Figure 2B:
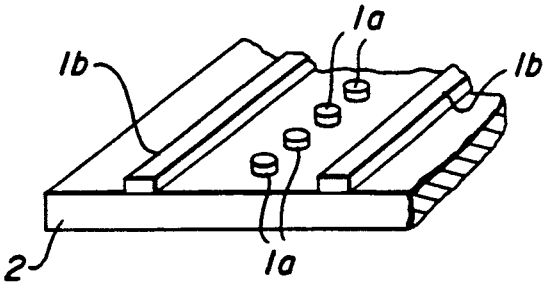

Referring to FIGS. 2A and 2B, the practice of the present invention, in general, involves coating an electrically conductive plate substrate 2 with a photoresist layer 1 of precise thickness. The composite element (shown in FIG. 2A, is exposed through masks and photolithographically processed to form a plurality of linear array peg patterns 1*a*, with separator ridges 1*b* therebetween. The peg patterns are non-conductive electrically, and have precisely uniform peg height and diameter. The non-conducting plating pattern can be formed of photoresist as described in U.S. Pat. Nos. 4,184,925 or anodized 4,971,665. However, as will be understood from subsequent discussion, the practice of the present invention is particularly useful in the methods where the orifice plate patterns comprise high resolution pegs, formed photolithography by use of spin coating and mask alignment technique. In the foregoing context, "high resolution" peg arrays are arrays having, for example, 240 or more pegs/inch to facilitate formation of orifice plates having correspondingly high resolution orifice arrays.

To obtain precise size uniformity for such high resolution arrays it is desirable to have precise photoresist layer thickness. This requires spin coating the substrate at speeds greater than 1000 rpm. In order to utilize such spin coating procedures, symmetrically balanced plating substrate shapes such as circular or square are advantageous (see substrate 2 in FIG. 5). While symmetric substrates are desirable for spin coating, they are not optimal in the plating system. That is, because the orifice plates which will be electroformed on the substrates are long and narrow, the symmetric substrate members cause non-optimum field distributions. This in turn causes non-uniformity of plating thickness and non-uniform diameter orifices.

Figure 5:
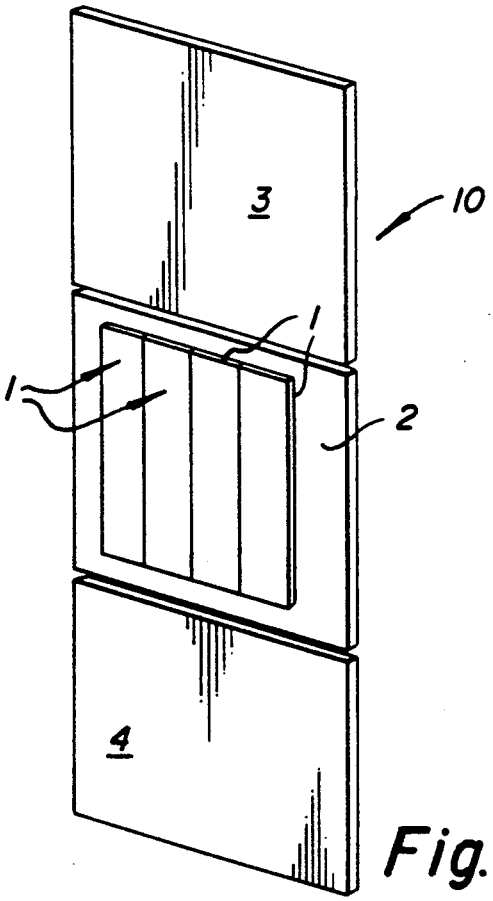
FIG. 5 is a perspective view of an electroplating substrate/robber panel unit according to the present invention.
Figure 6:
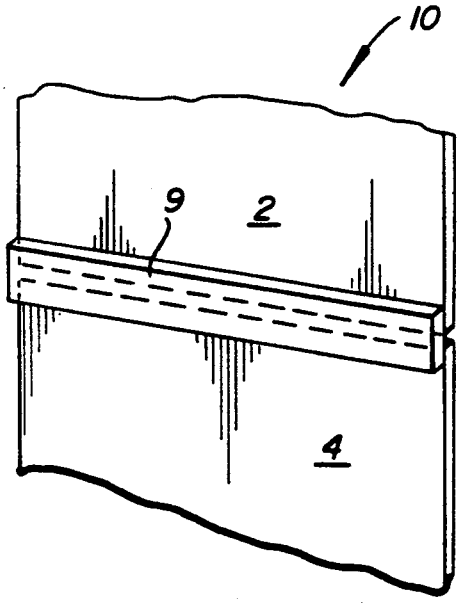
FIG. 6 is an enlarged portion of the FIG. 5 unit showing a preferred technique for electrically coupling the robber panels and electroplating substrate.

FIGS. 5 and 6 show one configuration for enabling plating upon a symmetric (square) substrate, while maintaining uniform field distribution. Thus, blank, electrically conductive panels 3 and 4, known in the electroplating art as robber panels, are placed adjacent those edges of the plating substrate 2 that are perpendicular to the length dimension of the arrays of photoresist peg patterns formed on the plating substrate. The robber panels have a thickness about equal to that of the plating substrate and have a width to be coextensive with the width of the plating substrate between shields 28. The length of the panels 3 and 4 is sufficient to render the plating field operating across the plating substrate of uniform magnitude.

In accord with the present invention the pattern bearing surface of plating substrate 2 is electrically coupled, along the sides adjacent each robber panel 3 and 4, to the coplanar surfaces of the adjacent robber panel sides. As shown in FIG. 6, a thin strip of electrically conductive material 9 is secured in electrical contact with the top surfaces of the plating substrate and adjacent robber panel is useful for this purpose. A particularly preferred material is a strip of electrically conductive copper-silicon adhesive tape, e.g. ¼ inch wide Scotch TM 9756-3 electrical tape. Other strip joining materials, e.g. thin metal strip and solder, will be apparent to those skilled in the art.

Figure 4:
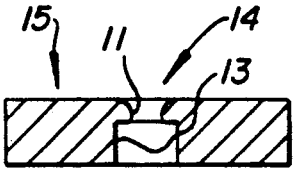
FIG. 4 is a cross-section of the FIG. 3 plate.
Figure 3:
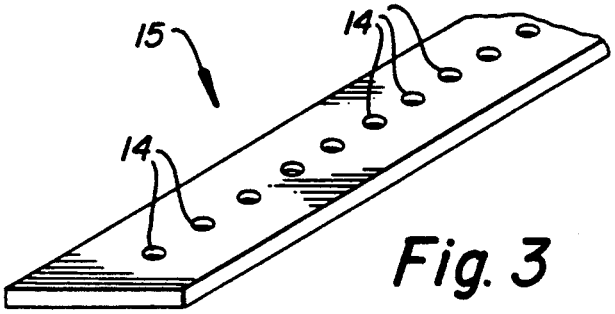
FIG. 3 is a schematic perspective of one orifice plate formed according to the present invention.

In practice of one preferred mode of the present invention, a plating substrate/robber panel unit 10 such as shown in FIGS. 5 and 6 is placed in fixture 26 as shown and described with respect to FIG. 1. The plating substrate of the unit has a symmetrical shape (e.g. is substantially square) and has a plurality of high resolution linear array peg patterns formed thereon by spin coating and mask exposure photolithographic steps as described with respect to FIGS. 2A and 2B. Fixture 26 is then placed in the electroplating system 20 shown in FIG. 1 and the system 20 is placed into a bath containing, e.g., a bright nickel plating solution. The system 20 is then electrically energized, in a manner known in the art, for a time period that accomplishes plating of nickel onto the plating substrate to a thickness 13 (see FIG. 4) equal to the height of pegs 1*a* and to an additional thickness 11 which extends over the top of the pegs 1*a* and defines the precise diameter of the individual orifices. The plating unit 10 is then removed from the plating system and the individual orifice plates 15, having high resolution orifices 14 of uniform diameter are provided in lengths longer than previously achievable.

For example use of the above described procedures, featuring robber panels coupled to a spin coated, symmetrical shaped plating substrate, enabled fabrication of a relatively long orifice plate having a thickness variation of no greater than about 0.01 mil. As a result, orifice plates having orifice arrays of about 4.25 inches with a resolution of 240 orifices per inch can be controlled to have an orifice size variation of ±0.03 mil.

The invention has been described in detail with particular reference to certain preferred embodiments thereof, but it will be understood that variations and modifications can be effected within the spirit and scope of the invention.

We claim:

1. A method for electroforming linear orifice plates comprising the steps of:

(a) forming a nonconductive linear peg pattern, corresponding to the desired orifice pattern, on the plating surface of an electrically conductive plating substrate having end edges which are substantially perpendicular to the linear peg pattern;

(b) placing electrically conductive robber panels adjacent said end edges of the plating substrate;

(c) coupling the plating surface of the plating substrate to the top surfaces of adjacent robber panels with a thin strip a electrically conductive material; and (d) placing the so-coupled plating substrate/robber panel unit in an electroplating system and operating that system for a predetermined period to form an orifice plate having a linear array of precisely uniform orifices.

2. The invention defined in claim 1 wherein said plating substrate is symmetrically balanced.

3. The invention defined in claim 2 wherein said peg pattern forming step includes spin coating photoresist material onto said substrate and photolithographically exposing and removing non-peg portions of the photoresist material.

4. The invention defined in claim 1 wherein said plating substrate is substantially square and has a plurality of high resolution linear patterns of precisely uniform size pegs thereon.

5. A method for electroforming linear orifice plates comprising the steps of:

(a) forming a linear array pattern of electrically insulative, uniform diameter and height pegs, corresponding to a desired orifice array pattern, on an electrically conductive plating substrate, said plating substrate having edges perpendicular to said linear array pattern;

(b) placing electrically conductive robber panels adjacent said edges of the plating substrate that are perpendicular to said linear array pattern;

(c) coupling the pattern bearing surface of said plating substrate to coplanar surfaces of adjacent robber panels with a thin strip of electrically conductive material;

(d) placing the coupled plating substrate/robber panel unit in an electroplating system; and (e) operating that system to form an orifice plate having a thickness slightly greater than said peg pattern height and a linear array of precisely uniform diameter orifices.

* * * * *